US005188269A

United States Patent [19]

Nakano

[11] Patent Number: 5,188,269

[45] Date of Patent: Feb. 23, 1993

[54] SHEET FEEDING DEVICE HAVING A PAPER PRESSER PLATE TO WHICH A VARIABLE BENDING MOMENT IS APPLIED

[75] Inventor: Norihito Nakano, Ohbu, Japan

[73] Assignee: Tokai Kogyo Kabushiki Kaisha, Ohbu, Japan

[21] Appl. No.: 650,967

[22] Filed: Feb. 5, 1991

[30] Foreign Application Priority Data

Aug. 22, 1990 [JP] Japan ..... 2-87525[U]

[51] Int. Cl.[5] ..... B65H 20/20

[52] U.S. Cl. ..... 226/74; 226/171; 400/616.1

[58] Field of Search ..... 226/74, 75, 171, 81, 226/82, 83; 220/315, 326, 335; 400/616.1, 616.2

[56] References Cited

U.S. PATENT DOCUMENTS

| | | | |
|---|---|---|---|
| 4,315,585 | 2/1982 | Seitz | 226/74 |
| 4,421,261 | 12/1983 | Hubbard | 226/74 |
| 4,605,822 | 2/1989 | Milano, Jr. | 226/74 |
| 4,952,087 | 8/1990 | Iwata et al. | 226/74 X |

*Primary Examiner*—Daniel P. Stodola
*Assistant Examiner*—P. Bowen
*Attorney, Agent, or Firm*—Oblon, Spivak, McClelland, Maier & Neustadt

[57] ABSTRACT

A sheet feeding device for feeding paper in a predetermined direction while a paper presser plate keeps the paper pressed to a sheet feeding mechanism. The sectional shape of the paper presser plate is modified according to the distribution of a bending moment applied to the paper presser plate so as to prevent creep.

4 Claims, 4 Drawing Sheets

SHEET FEEDING DEVICE HAVING A PAPER PRESSER PLATE TO WHICH A VARIABLE BENDING MOMENT IS APPLIED

BACKGROUND OF THE INVENTION

1. Field of the Invention

This invention relates to a sheet feeding device for feeding paper by applying a predetermined moving force to both edges thereof.

2. Description of the Related Art

In a printer for a computer, word processor, plotter or the like, a continuous form S as shown in FIG. 7 is often used for printing data such as characters and graphics. Feed holes S1 are provided at a predetermined pitch along the edges of the paper to be fed. A sheet feeding device 1 feeds such paper S while engaging with the feed holes S1 so as to apply a feeding force to the paper.

Usually a pair of the sheet feeding devices are disposed along the edges of the paper. In each of the sheet feeding devices 1, an endless belt 2 has a plurality of pins 3 projecting outwardly from its outer surface. These pins 3 engage with the feed holes S1 on the paper. The endless belt 2 is trained over drive sprocket wheels, not shown. When the endless belt 2 is driven by the sprocket wheel, the pins 3, on the straight portions of the endless belt 2, engage with feed holes S1 on the paper so as to apply the feeding force to the paper S.

The sheet feeding device 1 includes an openable paper presser plate 4. The paper presser plate 4 is usually kept closed by spring means, not shown. With the sheet feeding device 1 which is shown at the lower part of FIG. 7, the closed paper presser plate 4 presses the paper S toward the endless belt 2 so that the pins 3 engage with the feed holes S1 properly, which moves the paper regularly without disengagement.

To detach the paper from the sheet feeding device 1, the paper presser plate 4 is opened against the force of the spring means.

To assure normal sheet feeding, the paper presser plate 4 is required to apply a relatively large pressure to the paper so as to position the paper properly. Therefore, spring means having a relatively large spring constant is usually used to keep the paper presser plate 4 closed. However when the paper presser plate 4 is always exposed to a relatively large stress because of the force applied by the spring means, the paper presser plate 4 is often susceptible to creep. The paper presser plate 4 suffering from creep causes the clearance to vary between the paper and itself, thereby adversely affecting the sheet feeding function of the sheet feeding device 1.

To cope with such an inconvenience, it has been proposed to make the paper presser plate 4 from a material having a large Young's modulus such as polycarbonate, or materials containing a large amount of glass. However these measures lead to increased material cost, and it has been required to use inexpensive materials.

SUMMARY OF THE INVENTION

It is an object of this invention to provide a sheet feeding device, which can prevent the creep of the paper presser plate by a simple structure, and can assure a stable sheet feeding operation at a low cost.

According to the invention, the sheet feeding device is adapted to feed the paper in a specified direction while a paper presser plate presses the edges of the paper so as to move the paper toward the feeding direction. The cross sectional shape of the paper presser plate, which is at the right angles to the moving direction of the paper, is changed according to the distribution of an applied bending moment.

In the sheet feeding device, the section modulus of the paper presser plate is determined so as to be substantially maximum at a position where a substantially maximum bending moment is applied.

According to the invention, the paper presser plate is effectively shaped so as to cope with the applied bending moment, so that the paper presser plate can be made from a minimum amount of a relatively low grade material, can be protected against creep, and can maintain the predetermined clearance between the paper and the paper presser plate for a long period of time.

The sheet feeding device of the invention enables the sheet feeding operation to be properly performed by use of a low cost material.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
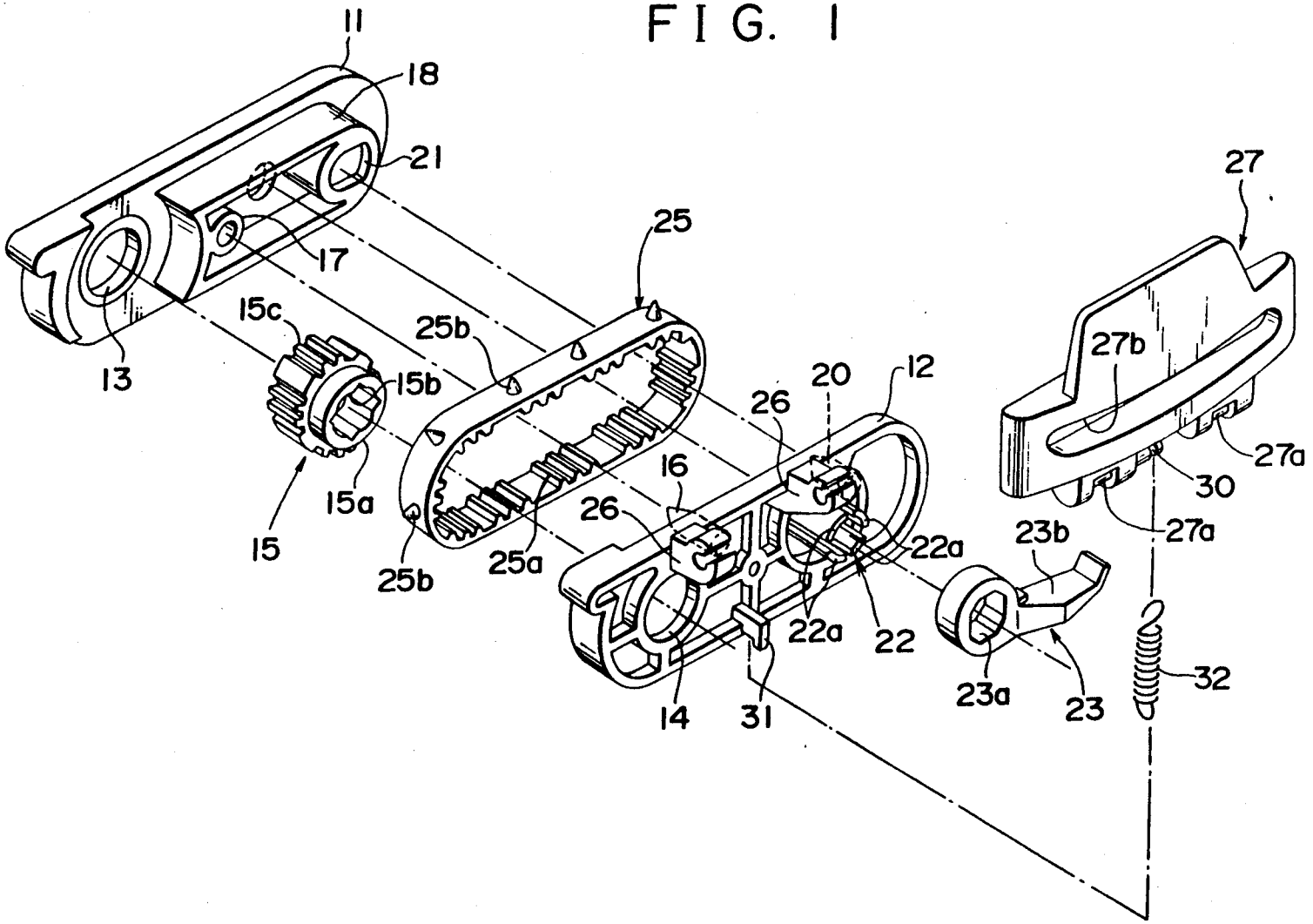
FIG. 1 is an exploded perspective view of the sheet feeding device of a first embodiment.

As shown in FIG. 1, the frame of the sheet feeding device comprises a first side frame 11 and a second side frame 12. The first side frame 11 is disposed at the center side of the paper S with respect to the side edge of the paper, while the second side frame 12 is disposed outside the side edge of the paper. These two frames 11, 12 are fastened together by a pin meshing mechanism to be described later.

The side frames 11, 12 have substantially rectanglar side surfaces and are provided with bearing through holes 13, 14, at one longitudinal end, respectively. These holes 13, 14 have the same axis. Boss portions 15*a* formed at axially opposite ends of a driving sprocket wheel 15 are rotatably engaged with these holes 13, 14.

Near its longitudinally central portion, the second side frame 12 is integrally provided with a cylindrical support pin 16 projecting toward the first side frame 11. The first side frame 11 has a hollow cylindrical member 17 for receiving the support pin 16. The cylindrical support pin 16 is fully and closely engaged in the hollow cylindrical member 17.

When the support pin 16 is fully engaged in the hollow cylindrical member 17, both of the first and second side frames 11 and 12 face each other as predetermined, so that the inner side of the first side frame 11 is adapted to come into contact with the projecting end of the hollow cylindrical member 17. Side frame 11 includes a strip-shaped belt guide 18, which projects toward the side frame 12 and extends from the side frame 11 as high as the axial length of the hollow cylindrical member 17. The projecting end of the belt guide 18 is adapted to come into contact with the inner side of the side frame 12. Thus both of the side frames 11 and 12 are mutually positioned with a predetermined clearance kept between them. An endless belt 25, to be described later, is rotatably disposed in the clearance between these side frames. The belt guide 18 serves to guide the endless belt 25, and includes a curved portion and a pair of straight portions extending laterally adjacent to the driving sprocket 15.

The second side frame 12 is integrally provided with a cylindrical support pin 20 at one longitudinal end thereof (upstream in the sheet feeding direction). This cylindrical support pin 20 projects toward the first side frame 11. The first side frame 11 is integrally provided with a hollow cylindrical member 21 for receiving the cylindrical support pin 20 of the second side frame 12. When they are engaged each other, both of the cylindrical support pin 20 and the hollow cylindrical member 21 serve to position the first and second side frames 11 and 12 properly.

Between the support pins 16 and 20, the second side frame 12 is integrally provided with a clamping sleeve 22 projecting outwardly in the direction opposite to the first side frame 11. Through the clamping sleeve 22, a support shaft connected to a drive control unit of a printer (not shown) is received in the first side frame 11. The clamping sleeve 22 includes four elastic cantilevers 22*a* which are separated by slits. A locking lever 23 is disposed around the clamping sleeve 22, and has a locking hole 23*a* at its boss portion so as to be engaged with the clamping sleeve 22. The locking lever 23 also includes an operation handle 23*b* which projects radially and has the predetermined length.

The locking hole 23*a* comprises arc-shaped portions for receiving the four cantilevers 22*a* of the clamping sleeve 22, and planar portions for pushing the cantilevers 22*a* centrally. These arc-shaped portions and the planar portions are alternately disposed in the locking hole 23. When the locking lever 23 is rotated by the operating handle 23*b*, the support shaft inside the clamping sleeve 22 is either unlocked or locked.

The driving sprocket 15 is rotatably engaged in the bearing holes 13, 14 when the first and second side frames 11, 12 are fastened together. Under this condition, there exists a small clearance between each axial side of the driving sprocket 15 and the inner sides of the side frames 11, 12. The driving sprocket 15 has a shaftway 15*b* of square cross section in its axial direction. The drive shaft, connected to the drive motor of the printer driving device (not shown), is adapted to fit in the inner shaftway 15*b* of the driving sprocket 15. On its outer surface, the driving sprocket 15 is provided with sprocket teeth 15*c* having the predetermined patterns and pitches. Teeth 25*a* which have the pitches and patterns same as those of the teech 15*c* are provided on the inner driven surface of the endless belt 25 , and are adapted to mesh with the sprocket teeth 15*c*.

As described above, the endless belt 25 is trained over the driving sprocket 15 and the belt guide 18, and is guided over these members without any slack.

A plurality of pins 25*b* project outwardly on the longitudinal center line of the outer surface of the endless belt 25, and are spaced apart equally with the predetermined pitch along the length thereof. These pins 25*b* are adapted to engage with the feed holes S1 on the paper S (shown in FIG. 7). When the endless belt 25 is driven by the driving sprocket 15, the pins 25*b* on the straight portions of the endless belt 25 engage with the feed holes S1 on the paper so as to feed the paper.

A pair of hinge bearings 26 are separately disposed along the upper outer edge of the second side frame 12 in its longitudinal direction (in the sheet feeding direction). A pair of hinge supports 27*a* are provided on the bottom portion of the sheet presser plate 27. These hinge supports 27*a* are rotatably fitted in the hinge bearings 26, so that the paper presser plate 27 is maintained movable. The movable range of the paper presser plate 27 is between the closed position where the plate 27 is in contact with the paper S (shown in FIG. 7) and the open position where the plate 27 somewhat deviates from the outer edge of the paper.

Figure 2:
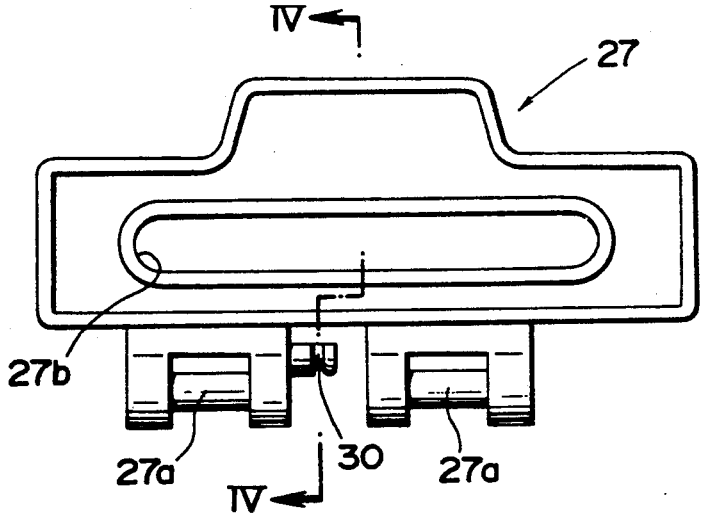
FIGS. 2 and 3 are an enlarged side elevational view and an enlarged bottom view of the sheet feeding device shown in FIG. 1.
Figure 3:
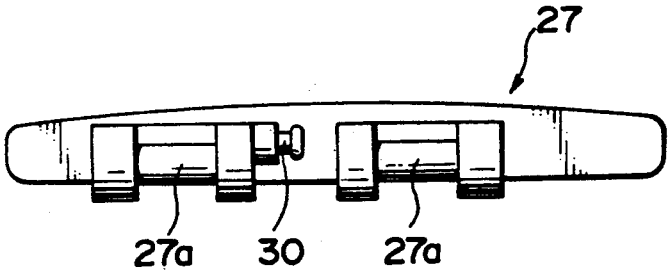
Figure 4:
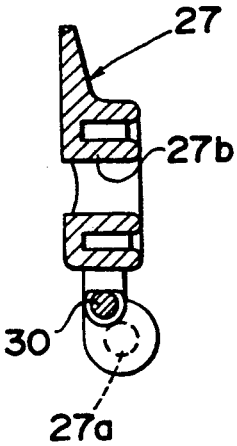
FIG. 4 is a sectional view taken along lines IV—IV of FIG. 2.

As shown in FIGS. 2 to 4, the paper presser plate 27 is provided with an upper hook 30 projecting at the predetermined offset position from one of the hinge supports 27*a*. In addition, a lower hook 31 is provided at a lower part of the second side frame 12. A coil spring 32 is tensioned over the hooks 30, 31. The upper hook 30 is at an offset position which is away from the hinge support 27*a* toward the paper, when the paper presser plate 27 is at the closed position. The rotational moment, which is applied to the plate 27 according to the offset of the hooks serves as a force to have the plate 27 closed. When the plate 27 is closed, the paper S is pushed toward the endless belt 25, so that the pins 25*b* on the endless belt 25 remain engaged with the feed holes S1 of the paper S, thereby allowing the paper to be fed without interruption.

The paper presser plate 27 is provided with an elongate hole 27*b* at a position which corresponds to the upper straight portion of the endless belt 25 in the running direction. When the paper presser plate 27 is closed, the pins 25*b* on the endless belt 25 are received in the elongate hole 27*b*, and can run freely without any interference by the paper presser plate 27.

To detach the paper S from the sheet feeding device, the paper presser plate 27 is opened against the force of the coil spring 32.

As specifically shown in FIG. 3, the thickness of the paper presser plate 27 is changed in the sheet feeding direction (in the right and left directions in FIG. 3), so that the paper presser plate 27 is thickest at its central portion and is thinned toward both ends. In other words, the sectional shape of the paper presser plate 27 which is at right angles with the paper in the sheet feeding direction is changed in the sheet feeding direction depending upon the bending moment applied thereto.

Figure 5:
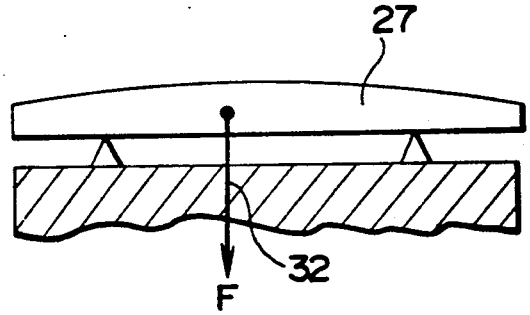
FIG. 5 is a side elevational view of a paper presser plate illustrating its principle of operation.

FIG. 5 shows the principle of operation of the force applied to the paper presser plate 27. To be more specific, the under surface of the paper presser plate 27 is flat so that it is uniformly in contact with the paper S, while the upper surface of the plate 27 is curved surface of the second order with a convex portion as shown in FIG. 5, since the upper surface never comes into contact with the paper. In addition, the thickest portion of the paper presser plate 27, i.e., the portion having the substantially maximum section modulus, corresponds to the position of the hook to which the coil spring 32 is hooked.

Figure 7:
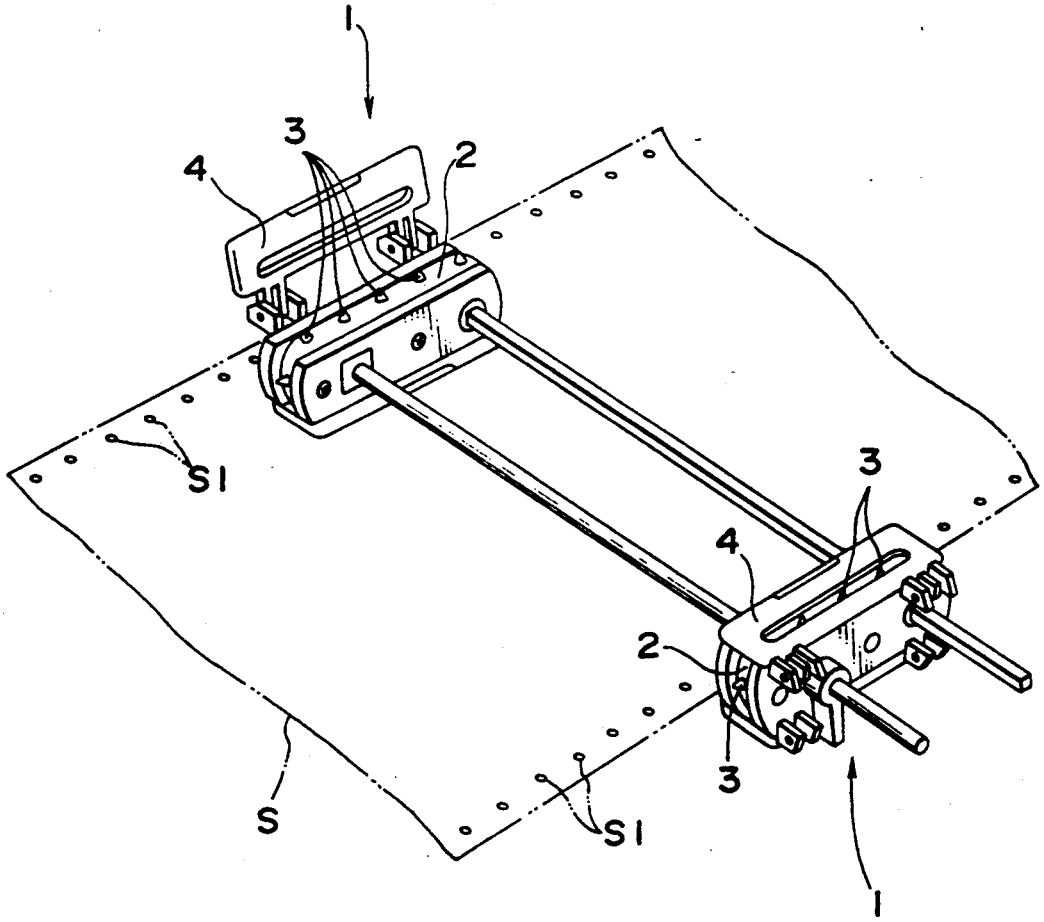
FIG. 7 PRIOR ART
FIG. 7 is a perspective view of a conventional sheet feeding device.

Now the distribution of the bending moment will be discussed. A bending moment is caused by the pulling force of the coil spring, and is applied to the paper presser plate 27 in the sheet feeding direction. Firstly, a maximum bending moment is generated at the hook for the coil spring 32, and is gradually decreased in the shape of a curve of the second order toward both ends of the paper presser plate 27. As described above, the section modulus (thickness) of the paper presser plate 27 is substantially maximum at the position corresponding to the hook for the coil spring 32, and the plate 27 is tapered (made thinner) towards the both ends so as to have substantially uniform thickness, as shown in FIG. 7.

According to the invention, the paper presser plate 27 is shaped so as to have a section modulus according to the distribution of the bending moment applied to the plate 27. The paper presser plate 27 has substantially maximum sectional moment at the position where the substantially maximum bending moment is applied. This means that the plate 27 is of a very effective shape. Therefore, even if it is made of a minimum amount of relatively low grade materials, the paper presser plate can be sufficiently protected against creep. In addition, the clearance between the paper presser plate 27 and the paper S can be maintained at a specified value for a long period of time.

Conventional paper presser plates have been made of polycarbonate containing glass. The paper presser plate of this invention was experimentally made of ABS (acrylonitrile-butadiene-styrene resin) containing glass. It has been confirmed that the paper presser plate is durable in operation for a long period of time. The paper presser plate mentioned above can be manufactured relatively inexpensively compared with conventional paper presser plates.

Even when the substantially maximum section modulus portion (thickest portion) of the paper presser plate 27 somwhat deviates from the hook for the coil spring 32, the paper presser plate 27 can assure the operation and advantages similarly to the first embodiment when such deviation is within predetermined range.

Figure 6:
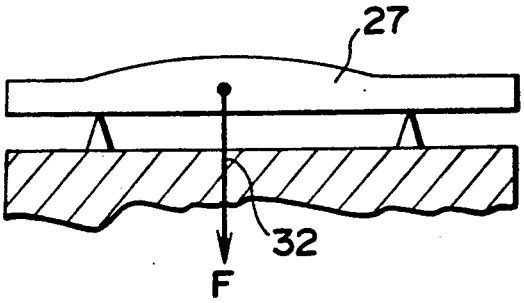
FIG. 6 is a side elevational view of a paper presser plate in a second embodiment.

With the embodiment shown in FIG. 6, the paper presser plate 27 is thickest (having substantially the maximum section modulus) at its central portion where the coil spring 32 is hooked. The paper presser plate 27 is tapered toward its ends and is flattened near the ends. According to this embodiment, the paper presser plate can assure the operation and advantages similarly to the foregoing embodiments.

Obviously, numerous modifications and variations of the present invention are possible in light of the above teachings. It is therefore to be understood that within the scope of the appended claims, the invention may be practiced otherwise than as specifically described herein.

What is claimed is:

1. A sheet feeding device for feeding paper in a predetermined direction while pressing the edges of the paper, which comprises:

a frame;

a feeding mechanism positioned in said frame;

a paper presser plate connected to said frame; and means for applying a bending moment to said presser plate wherein said paper presser plate has a thickness which varies corresponding to the distribution of bending moment applied to said paper presser plate and has an upper surface which is curved in said feeding direction.

2. A sheet feeding device according to claim 1, wherein said upper surface has a convex curved surface.

3. A sheet feeding device according to claim 1, wherein said paper pressure plate has tapered opposite ends.

4. A sheet feeding device for feeding paper in a predetermined direction while pressing the edges of the paper about, which comprises:

a frame;

a feeding mechanism positioned inside frame; and a paper presser plate connected to said frame wherein said paper presser plate has an upper surface which has curved inset feeding direction wherein a section modulus of said paper presser plate is substantially at a maximum at a position where a substantially maximum bending moment is applied thereto.

* * * * *